US008393812B2

(12) United States Patent
Shultz

(10) Patent No.: US 8,393,812 B2
(45) Date of Patent: Mar. 12, 2013

(54) HOLDER FOR HAND-HELD INSTRUMENT

(75) Inventor: Mark A. Shultz, Newport, NH (US)

(73) Assignee: Concord Scientific, Inc., Concord, MA (US)

( * ) Notice: Subject to any disclaimer, the term of this patent is extended or adjusted under 35 U.S.C. 154(b) by 380 days.

(21) Appl. No.: 12/584,866

(22) Filed: Sep. 14, 2009

(65) Prior Publication Data

US 2011/0064510 A1 Mar. 17, 2011

(51) Int. Cl.
*A46B 5/02* (2006.01)

(52) U.S. Cl. ..... 401/6; 401/88

(58) Field of Classification Search ..... 401/6, 88, 401/7, 131, 48; 294/25, 1.1; 16/430
See application file for complete search history.

(56) References Cited

U.S. PATENT DOCUMENTS

| | | | | |
|---|---|---|---|---|
| 249,893 | A | 11/1881 | Bulkeley | |
| 945,026 | A | 1/1910 | Faust | |
| 1,291,972 | A | 1/1919 | McGuigan | |
| 1,840,191 | A * | 1/1932 | Eubanks | 401/6 |
| 2,173,451 | A | 9/1939 | Lorber | 120/103 |
| 2,236,194 | A | 3/1941 | Lorber | |
| 2,292,324 | A | 8/1942 | Lawrence | 120/103 |
| D149,677 | S | 5/1948 | Roblin | D7/395 |
| 2,594,955 | A | 5/1955 | Appel | 120/84 |
| D185,824 | S | 8/1959 | Armstrong et al. | D74/17 |
| D189,170 | S | 11/1960 | Lovejoy | D74/17 |
| D202,395 | S | 9/1965 | Lamb | D74/17 |
| D228,418 | S | 9/1973 | Locke | D74/17 |
| 3,947,977 | A * | 4/1976 | Bishop | 434/166 |
| 2,709,419 | A | 6/1977 | Balasty | 120/103 |
| 4,030,841 | A | 6/1977 | Balasty | 401/6 |
| 4,035,865 | A | 7/1977 | McRae et al. | 16/114 R |
| 4,167,347 | A | 9/1979 | Hoyle | 401/88 |
| D256,925 | S | 9/1980 | Postrehovsky-Axel | D19/47 |
| 4,596,335 | A * | 6/1986 | Hull | 211/69.1 |
| D292,104 | S | 9/1987 | Keller, Jr. | D19/55 |
| D298,439 | S | 11/1988 | Rusk | D19/55 |
| 5,310,345 | A | 5/1994 | Gershon | 434/166 |
| 5,391,010 | A | 2/1995 | Gorbunov | 401/8 |
| 5,853,210 | A | 12/1998 | Robinson | 294/25 |
| 6,036,385 | A | 3/2000 | Bistrack | 401/6 |
| 6,079,758 | A | 6/2000 | Romero et al. | 294/25 |
| 6,328,494 | B1 | 12/2001 | Moxon | 401/8 |
| 6,705,788 | B2 | 3/2004 | Gadberry | 401/6 |
| 6,905,271 | B1 * | 6/2005 | Short | 401/8 |
| 7,070,351 | B2 | 7/2006 | Cooper et al. | 401/6 |
| 7,128,484 | B2 | 10/2006 | Schulken | 401/6 |
| 7,334,298 | B2 | 2/2008 | Willat et al. | 16/435 |
| 7,335,176 | B2 | 2/2008 | Bennett | 602/20 |

* cited by examiner

*Primary Examiner* — David Walczak
(74) *Attorney, Agent, or Firm* — Nields, Lemack & Frame, LLC

(57) ABSTRACT

Hand-held device that accommodates an instrument, preferably a writing instrument. In certain embodiments, the device is a unitary elongated member that is shaped and configured to receive an instrument such as a pen or pencil, thereby defining a holder and instrument assembly. It has a curvilinear generally central portion which is shaped and positioned to rest against the hand of the user between the index finger and thumb. A plurality of bores receive the instrument and secure it in place to create a unitary assembly that allows the user to readily and easily control the instrument. The instrument is readily removable from the device.

7 Claims, 3 Drawing Sheets

HOLDER FOR HAND-HELD INSTRUMENT

BACKGROUND

This disclosure relates to a holder for instruments, such as writing devices, and in particular, a holder for writing devices that facilitates the ability of handicapped individuals to master the skill of writing.

Arthrogryposis Multiplex Congenita, or AMC, is a rare musculoskeletal disorder characterized by reduced mobility of many joints of the body. Impaired mobility is due to the overgrowth of fibrous tissue in the joints. There are many different types of AMC and the symptoms and manifestations of the disorder vary widely among affected patients. Amyoplasia, the generalized lack in the newborn of muscular development and growth, with contracture and deformity at most joints, is the most common form of AMC. In this most common form of AMC, the range of motion of the joints in the arms and legs is limited or fixed. Other manifestations include adducted and inward rotation of the shoulders, abnormal malextension of the elbows, bending of the wrists and fingers, inwardly bent heels from the midline of the leg, and inwardly bent feet at the ankle (clubfoot). The cause of AMC is unknown, although it is believed that one major cause is fetal akinesia (decreased fetal movements) due to fetal abnormalities such as neurogenic, muscle, or connective tissue abnormalities or maternal disorders. There is no current cure.

Individuals suffering from AMC may have difficulty writing legibly, often due to their inability to properly grasp and hold the writing implement in view of the limitations imposed by AMC on the movement of the fingers, hand and wrist. Indeed, the conventional method of holding a writing implement, which involves the combined use of the thumb, index finger and middle finger of the writing hand biased against the writing implement to create a tight grip, may be difficult or impossible for those suffering from one or more of the aforementioned physical issues.

Other handicaps, disabilities, impairments, deformities, injuries, diseases and conditions, temporary or permanent, such as arthritis, muscular dystrophy, hypokinesia, tendonitis, chronic pain, repetitive stress injuries, carpal tunnel syndrome, multiple sclerosis, cerebral palsy, missing digits, sprained or broken fingers, wrists or hands, etc., can result in similar or even more problematic difficulty in gasping, holding, using and/or manipulating an implement.

It would therefore be desirable to provide an ergonomic device particularly well-suited for individuals with a compromised ability to manipulate hand-held instruments, including but not limited to a compromised ability to grasp, hold and/or manipulate instruments such as conventional writing devices, in order to facilitate and/or assist the individual in using the device in a comfortable manner for its intended purpose.

SUMMARY

The problems of the prior art have been overcome by the present disclosure, which discloses a hand-held device that accommodates an instrument, preferably a writing instrument. The device is shaped and configured to facilitate writing effectively and legibly, and at a faster rate, by an individual with a compromised ability to write (which includes a compromised ability to grasp, hold and/or manipulate a writing instrument). The device is also useful to individuals who desire to reduce hand and/or finger fatigue during use of a hand-held instrument. In certain embodiments, the device is a unitary elongated member that is shaped and configured to receive an instrument such as a pen or pencil, thereby defining a holder and instrument assembly. In certain embodiments, the device has a curvilinear generally central portion which is shaped and positioned to rest against the web of the hand of the user between the index finger and thumb, and which governs the angle at which the instrument is held during use. In certain embodiments, the device includes a plurality of bores which receive the instrument and secure it in place to create a unitary assembly that allows the user to readily and easily control the instrument.

The disclosure also encompasses a method of writing, including providing a device for receiving and securing an instrument such as a writing instrument, securing an instrument in the device, and gripping the device with the hand of a user in a manner conducive for using the instrument effectively and efficiently. In certain embodiments, the method includes placing the underside of the device against the side of the middle finger of the writing hand and between the index finger and the thumb, and gripping the forward or proximal end of the device by at least partially wrapping the index finger about the device, and in cooperation with the thumb, applying slight pressure to the device with the index finger and thumb to grip the same.

DETAILED DESCRIPTION

Figure 1:
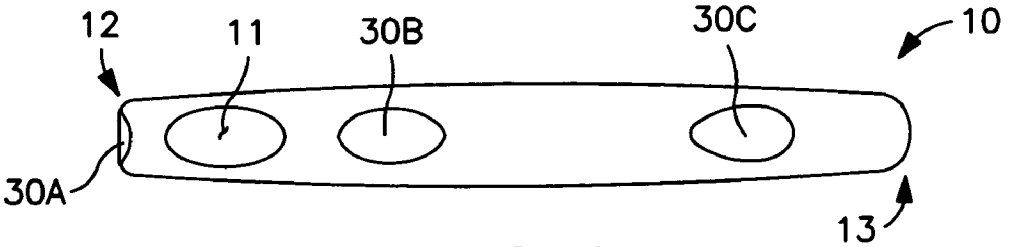
FIG. 1 is a top view of the device in accordance with certain embodiments.
Figure 2:
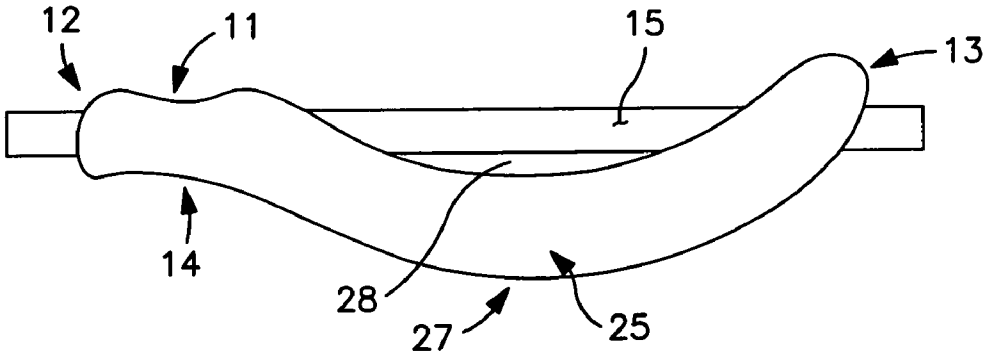
FIG. 2 is a side view of the device of FIG. 1, shown with a writing implement secured therein.

Turning first to FIGS. 1 and 2, there is shown instrument holder 10 in accordance with certain embodiments. The instrument with which the holder 10 can be used by an individual is not particularly limited, and includes writing instruments such as pens, pencils, markers, crayons, chalk, paint brushes, etc., as well as other hand-held instruments including razors, knives, surgical and dental instruments, cosmetic applicators, toothbrushes, hair brushes, combs, eating utensils (e.g., forks and spoons), and hand-held tools such as soldering irons. Preferably the instrument has an elongated barrel portion and a working or operating end for carrying out an operation such as writing.

Although the materials of construction of the holder 10 are not particularly limited, and include plastics such as injection molded plastic, foam, composite materials and thermoplastic polymers, preferably the instrument holder 10 is made of a non-slip rubber material that enhances the ability to grip the device. Preferably the holder 10 is manufactured by injection molding, such as by using a two-part mold with a polyolefin such as polypropylene, and a thermoplastic elastomer overmold. Alernatively, a one-piece material using a firm durometer thermoplastic elastomer could be made.

Figure 6:
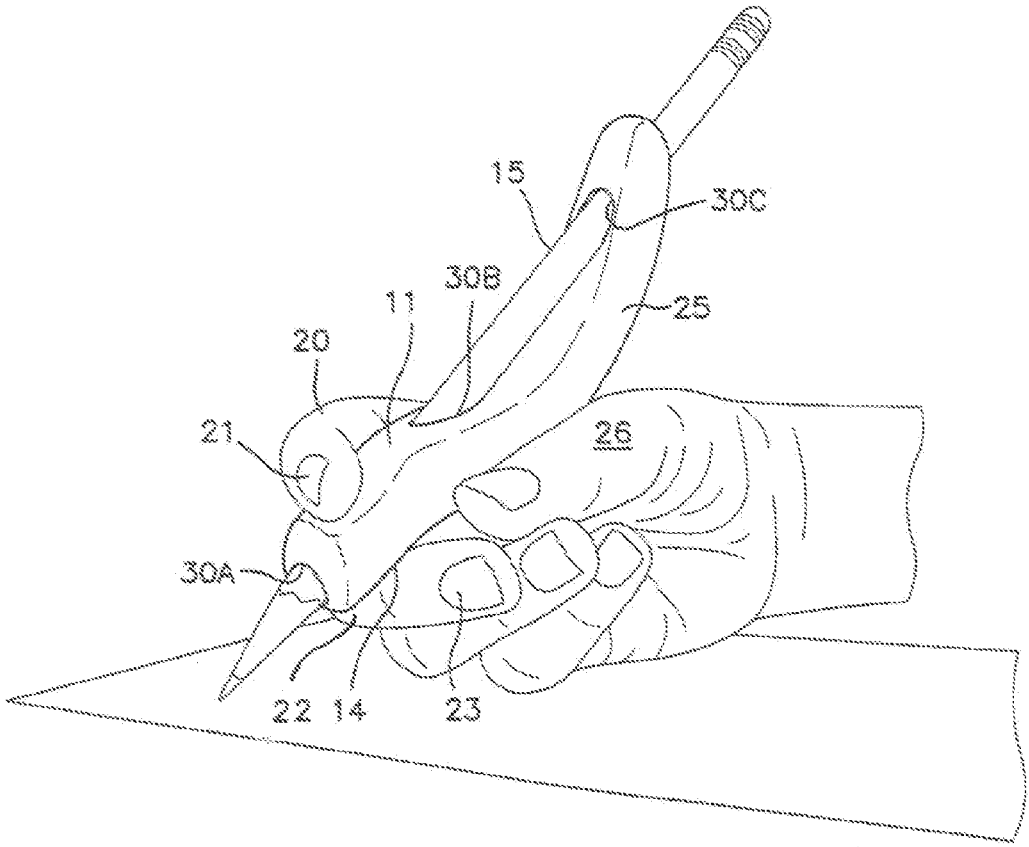
FIG. 6 is a perspective view of a user's hand holding the device of FIG. 1 with a writing implement secured therein.

In the embodiment shown, the holder 10 is an elongated body, with a proximal end 12, a distal end 13 spaced from the proximal end 12, and a generally central curvilinear portion between the proximal and distal ends. The holder 10 has a plurality of bores configured and positioned to removably receive the instrument. The holder 10 includes an index finger position area 11, which is preferably contoured in a concave manner, preferably forming a saddle-shaped indentation or depression in the longitudinal direction, as best seen in FIG. 2. The area 11 receives and accommodates the interior portion and underside of the index finger 20, juxtaposed to the finger nail 21, as seen in FIG. 6. It is positioned spaced from the proximal end 12 of the holder 10 a distance sufficient to allow the user to properly control the working end of the instrument 15 extending through the holder 10. One suitable distance is from about 0.65 inches to about 0.66 inches from the end 12 to the center of area 11 of the holder 10. The area 11 is also preferably positioned directly above a corresponding curved portion or undercut 14 on the opposite side of the holder 10 where, in use, the holder 10 rests on the interior of the middle finger 22 of the user, at or above (i.e., towards the middle finger fingernail 23) the middle finger knuckle. The index finger position area 11 helps locate and secure the index finger 20 in place in a position where it is most comfortable and can effectively grip the holder and assist in operating the instrument 15. It is dimensioned to provide sufficient area to allow the index finger 20 to move slightly to re-adjust the positioning of the finger in case of fatigue, for example, yet remain within the general area 11. In certain embodiments, the area 11 can be textured, such as with ribs, knurls, bumps, recesses, or other discontinuities to enhance the tactile properties of the grip.

The holder 10 includes a generally central portion 25 that is curvilinear, extending in a downwardly direction relative to the proximal and distal ends when the holder is positioned as in FIG. 2, to form an arch shape. The generally central portion 25 is curved gradually in a direction radially outwardly of the longitudinal axis of the holder 10 until it reaches a maximum curve at 27, and then curves gradually radially inwardly until it terminates in distal end 13. As a result, the axis intersecting the center of each of the plurality of bores 30 does not intersect the central portion 25 in the area where the radial distance of the central portion is farthest from the longitudinal axis of the holder 10. Accordingly, an instrument inserted through the bores as in FIG. 2 extends through one bore to the next without contacting the central portion 25 where its curve or arch is most pronounced, as seen by the gap 28 in FIG. 2. However, in certain embodiments, such as where the instrument has a thick middle, contact with the central portion is acceptable.

Figure 7:
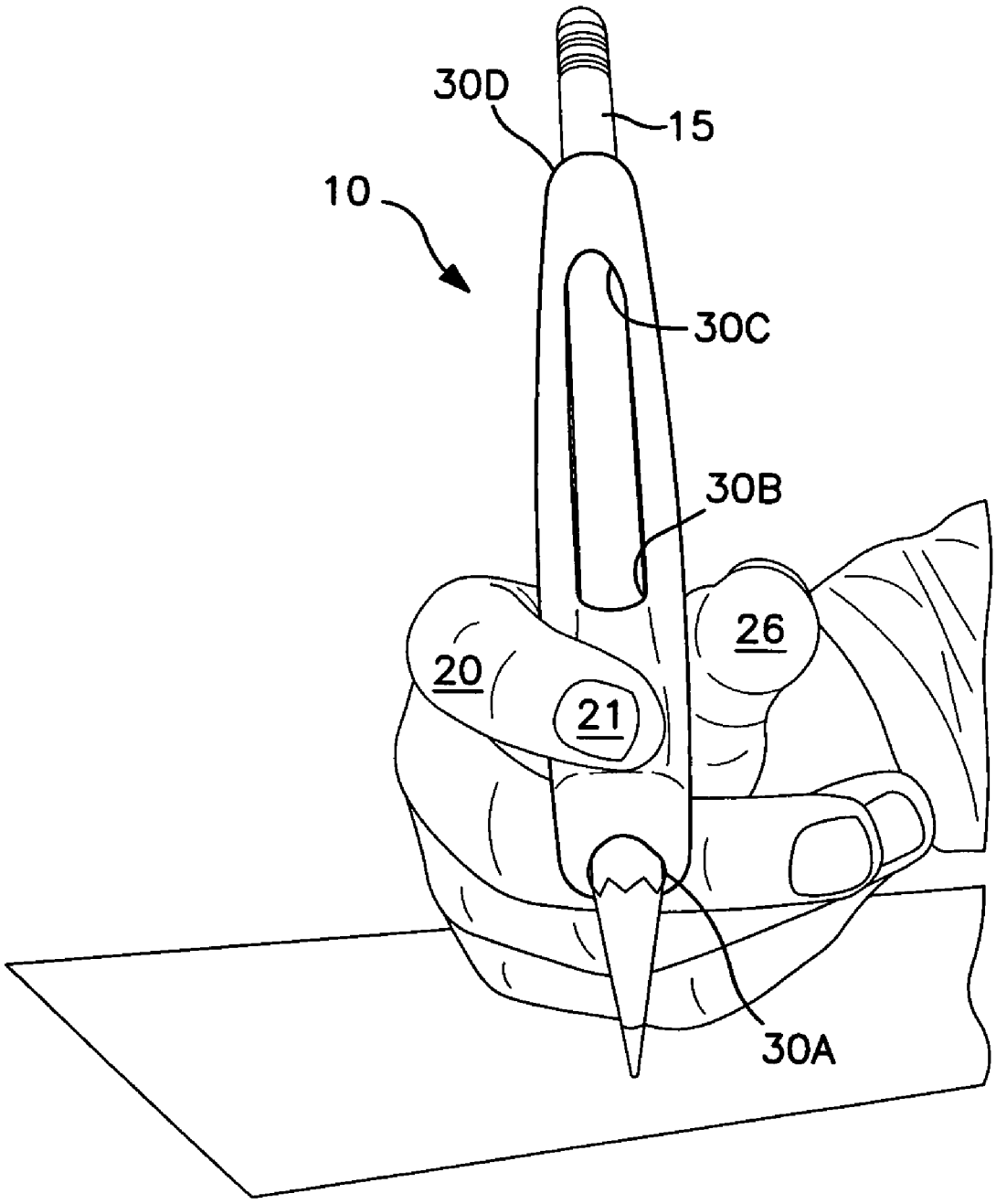
FIG. 7 is another perspective view of a user's hand holding the device of FIG. 1, with a writing implement secured therein.

When in use, the surface of the arch rests on the user's hand between the index finger 20 and the thumb 26. The extent of the curve or arch is a factor in determining the angle at which the instrument 15 is held at during operation, such as during the writing process in the case where the instrument 15 is a writing instrument. An angle of from about 50° to about 55° from horizontal (e.g., from the longitudinal axis of the instrument 15 when secured in the holder 10) has been found to be suitable. With the arch resting between the index finger 20 and the thumb 26, and the undercut 14 resting on the middle finger, the index finger 20 is partially wrapped around the holder 10 so that the tip of the index finger 20 rests in the area 11, as best seen in FIG. 6 and FIG. 7. The user's thumb 26 grips the holder 10 cooperatively with the index finger 20 with just enough force to secure the assembly in the hand and gain effectuate control over use of the instrument. The user can then easily and comfortably manipulate the assembly, such as by causing the working or operating end of the instrument held by the holder to engage a substrate and dispense ink or lead thereon. Stability of the device while writing is attained.

Figure 3:
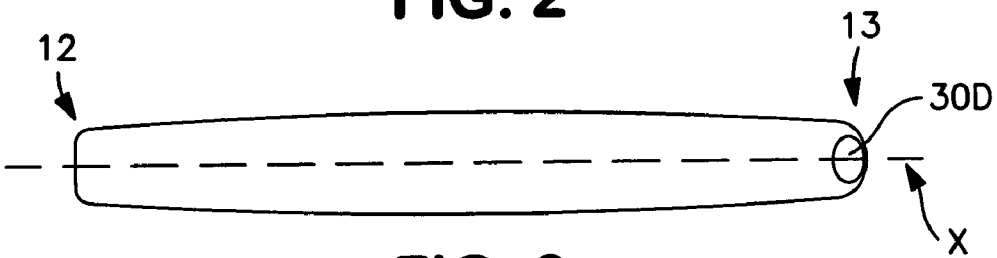
FIG. 3 is a bottom view of the device of FIG. 1.

As can be seen in FIGS. 1 and 3, the holder 10 is symmetrical about its longitudinal axis x, so that it can be used without modification by either a right-handed user or a left-handed user.

Figure 4:
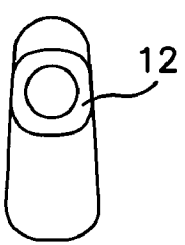
FIG. 4 is a front view of the device of FIG. 1.
Figure 5:
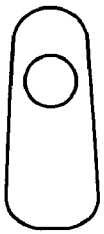
FIG. 5 is a rear view of the device of FIG. 1.

The holder 10 includes a plurality of mounting bores 30A, 30B, 30C and 30D for receiving the instrument. Since most instruments that will be secured by the holder are rigid and straight, preferably each of the plurality of bores is linearly aligned with the others along a longitudinal axis of the holder 10, as can be seen in FIGS. 4 and 5. The bores 30 are preferably circular in cross-section, where that cross-section is perpendicular to the axis of the implement 15 when properly positioned in the holder 10 (as in FIG. 2). As can be seen in FIG. 1, a top view of the bores 30B and 30C shows that they are tear-drop shaped in order to slidingly receive (and allow removal of) the instrument with ease. The diameters of the bores, measured in the circular cross-section taken perpendicularly to the axis of the implement 15, are preferably all equal, and preferably about equal to the outside diameter of the implement 15 so that a friction fit of the implement in the holder 10 is accomplished. If the diameters of the bores are significantly larger than the diameter of the instrument, the instrument will slip out of the holder too easily. Accordingly, it is preferred that at least one of the bores, and more preferably two or more of the bores, have diameters equal to or about equal to the diameter of the instrument.

The instrument 15, when secured in the holder 10, extends beyond the proximal end 12 so that the operative portion of the instrument (e.g., the ball point of a ball point pen or the leaded tip of a pencil) is exposed.

The removability feature of the holder 10 allows the user to use different instruments without requiring holders for each. For example, if the user desires to write with a pencil, he simply inserts the pencil through the plurality of bores until the working end of the pencil extends the appropriate distance from the proximal end 12 of the holder 10. If the user later desires to write with a pen, the pencil is removed from the holder 10 by pulling it out either the proximal or distal end and the pen is inserted.

The embodiment shown has been made, and it was tested by an individual suffering from AMC and was shown to improve the neatness of his writing, and reduced the time required to write his name from 84 seconds to 56 seconds.

What is claimed is:

1. A holder and an instrument held in said holder, said holder comprising a holder body having a proximal region having a first surface and a first end and a distal region having a second surface and a second end, said distal region being spaced from said proximal region, and a central portion between said first and second ends, said central portion comprising a curvilinear portion having a curvilinear surface, said holder body having a first passageway extending through said proximal region and a second passageway extending through said distal region, said first and second passageways being linearly aligned and receiving said instrument, said holder body having a continuous surface comprising said first surface of said proximal region, said curvilinear surface and said second surface of said distal region, each of said first and second passageways penetrating said respective first and second surfaces and said curvilinear surface, and said holder body having an axis intersecting the center of each of said first and second passageways, wherein said axis does not intersect said central portion.

2. The holder of claim 1, wherein said holder body further comprises a generally concave indentation in said proximal region.

3. The holder of claim 1, wherein said curvilinear portion is arched such that said instrument extends out of said first passageway and into said second passageway without contacting said curvilinear portion.

4. The holder of claim 1, wherein said instrument is a writing instrument.

5. The holder of claim 4, wherein said instrument is a pen or pencil.

6. A method of writing by a user, comprising providing a holder for a writing instrument having a working end, said holder comprising a holder body having a proximal region having a first end and a distal region having a second end, said distal region being spaced from said proximal region, and a central portion between said first and second ends, said central portion comprising a curvilinear portion, said holder body having a first passageway extending through said proximal region and a second passageway extending through said distal region, said first and second passageways being linearly aligned for receiving said instrument; inserting said instrument through said first and second passageways such that said instrument is secure in said holder and said working end extends from said first end of said holder; placing the underside of said device against the side of the middle finger of the writing hand of the user and between the index finger and the thumb of the user, gripping said first end of the device by at least partially wrapping the index finger about the device, and in cooperation with the thumb, applying pressure to said holder with the index finger and thumb; and contacting said working end with a substrate to write thereon.

7. The method of claim 6, wherein said holder body further comprises a generally concave indentation in said proximal region, said method further comprising positioning the interior portion and underside of said index finger on said indentation.

* * * * *